United States Patent [19]

Inaba

[11] Patent Number: 4,556,769

[45] Date of Patent: Dec. 3, 1985

[54] KEY SWITCH DEVICES WITH KEY GUIDE MEANS

[75] Inventor: Hiroshi Inaba, Kawasaki, Japan

[73] Assignee: Nitsuko Limited, Kawasaki, Japan

[21] Appl. No.: 620,901

[22] Filed: Jun. 15, 1984

[30] Foreign Application Priority Data

Jun. 15, 1983 [JP] Japan ..... 58-90489[U]

[51] Int. Cl.[4] ..... H01H 3/12

[52] U.S. Cl. ..... 200/340

[58] Field of Search ..... 200/5 A, 159 B, 314, 200/340; 400/479, 495

[56] References Cited

U.S. PATENT DOCUMENTS

| | | | |
|---|---|---|---|
| 3,856,998 | 12/1974 | Sims, Jr. | 200/340 X |
| 4,117,279 | 9/1978 | Schoemer | 200/314 X |
| 4,363,942 | 12/1982 | Deeg et al. | 400/479 X |
| 4,468,542 | 8/1984 | Pounds | 200/340 X |

FOREIGN PATENT DOCUMENTS

| | | | |
|---|---|---|---|
| 2713207 | 10/1978 | Fed. Rep. of Germany | 200/340 |

*Primary Examiner*—J. R. Scott

*Attorney, Agent, or Firm*—Roberts, Spiecens & Cohen

[57] ABSTRACT

A key switch device having a key being depressable to allow a movable contact to come into contact with a pair of fixed contacts. The key is elastically supported in an opening of a housing plate and is prevented from slipping out of the opening by engagement with the key and the housing plate. The housing plate has a plurality of guide grooves formed in the inner surface of the opening in parallel with a center axis of the opening. A plurality of guide projections are formed on the lower side of the key and are slidably fitted into the guide grooves, respectively. The key can be smoothly and straightly moved along the center axis of the opening by a force applied to any point on the upper surface of the key without being inclined from the center axis.

11 Claims, 6 Drawing Figures

KEY SWITCH DEVICES WITH KEY GUIDE MEANS

BACKGROUND OF THE INVENTION (1) Field of the Invention

This invention relates to key switch devices, and particularly, to key switch devices wherein a key is depressable to allow a movable contact to come into contact with a pair of fixed contacts.

(2) Description of the Prior Art

A conventional key switch device, which is used in various electrical and electronic devices, for example, a key telephone set, includes an electric circuit board, an insulator housing plate fixedly disposed on an upper surface thereof and having an opening, and a key slidably fitted in the opening and elastically supported therein. The key is accompanied with a movable contact which moves together with the key. The circuit board has a pair of fixed contacts formed on the upper surface. The pair of fixed contacts is closed or connected with one another by the movable contact when the key is pushed down against the elastic support so that the movable contact comes into contact with the fixed contacts.

It has been known that such a key is provided with elastically flexible leg portions extending downwardly, each of which has engaging means for engaging with the housing plate. When the key is mounted on the housing plate, leg portions are slightly bent inwardly in a radial direction so as to be inserted in the opening of the housing plate. Therefore, it is desired that each of the leg portions can be readily elastically bent. After that, the key is straightly guided by the inner peripheral surface of the opening of the housing plate and that leg portions are restored so that engaging means engage with the opening edge of the housing plate, to thereby prevent the key from slipping out of the opening of the housing plate. In this construction, since the key can be inserted into the opening from the upper side of the housing plate which has been fixedly secured to the circuit board, the key switch device can be readily assembled.

Particularly, if the leg portions are longer, the mounting of the key on the housing plate can be readily carried out because the leg portions can be readily bent inwardly. However, if a force is applied to the key at a position offset from the center of the key to push down the key, the key is inclined from the center axis of the opening because the leg portions are elastically bent inwardly. As a result, the key is not smoothly and straightly moved along the center axis of the opening of the housing plate. Therefore, the movable contact does not reliably come into contact with the pair of fixed contacts.

On the other hand, if the leg portions are shorter, it can be difficult to mount the key on the housing plate. Because the leg portions can not be readily bent inwardly, the engaging means engages with the edge of the opening of the housing plate thereby to prevent the leg portions from being inserted into the opening.

In order to insure a reduced inclination of the key pushed at its peripheral edge, the leg portions are provided to a peripheral edge of the key in the known key switch device. In the case, use of a key having an increased area of the top surface means that the opening of the housing plate is large, which results in a large key switch.

SUMMARY OF THE INVENTION

It is therefore an object of the present invention to provide a key switch device, wherein a key can be easily mounted on a housing plate and smoothly and pushed straight down even if an offset force applied to a peripheral portion of a face of the key.

It is another object of this invention to provide a key switch device, which has a key having a relatively large operable top surface in comparison with a given volume of the key switch device.

As described above, a key switch device comprises an electric circuit board having a pair of fixed contacts on an upper surface thereof, a housing plate being fixedly disposed on the upper surface of the circuit board and having an opening with a center axis intersecting with the upper surface of the circuit board, a key having a face plate portion and a plurality of leg portions projecting from angularly spaced locations on a bottom surface of the face plate portion, the key being mounted on the housing plate with the leg portions being fitted into the opening and arranged around the center axis of the opening, each of the leg portions being elastically flexible in a radial direction of the opening and having engaging means for engaging with the housing plate to prevent the key from slipping out of the opening upwardly, supporting means for elastically supporting and urging the key upwardly, and a movable contact being accompanied with the key to come into contact with the pair of fixed contacts at each time when the key is pushed down. According to the present invention, the housing plate has a plurality of guide grooves extending in parallel to the center axis of the opening, and the key has a plurality of guide projections projected from the bottom surface of the face plate portion and slidably fitted into the guide grooves, respectively.

Further objects, features and other aspects of the present invention will be understood from the following description of preferred embodiments referring to the accompanying drawings.

DETAILED DESCRIPTION OF PREFERRED EMBODIMENTS

Prior to a description of embodiments of the present invention, the prior art will be described below.

Figure 1:
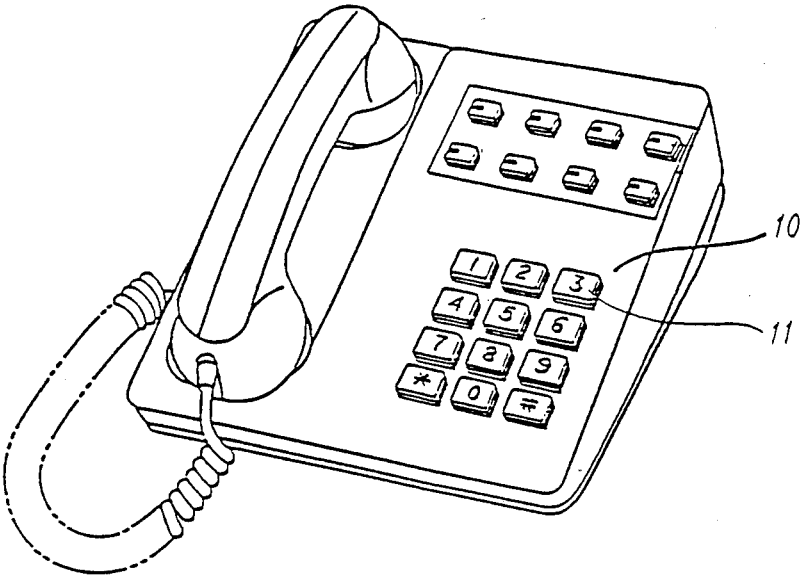
FIG. 1 PRIOR ART
FIG. 1 is a perspective view of a key telephone set using a conventional key switch device.

Referring to FIG. 1, a key telephone set 10 includes a plurality of key switch devices, each of which is provided with a key 11. Such a key switch device will be described referring to FIG. 2.

Figure 2:
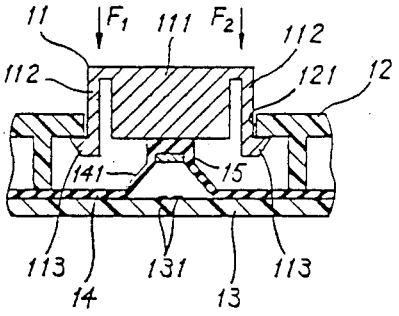
FIG. 2 PRIOR ART
FIG. 2 is a sectional view of a known key switch device.

Referring to FIG. 2, an insulator housing plate 12 has an opening 121 for receiving key 11. Key 11 is slidably fitted into opening 121. A printed electric circuit board 13 is stationarily disposed inside, and spaced from, housing plate 12. Printed circuit board 13 has a pair of fixed contacts 131 on the upper surface thereof, and metal patterns (not shown) for connecting fixed contacts 131 with an external electric circuit (not shown). A rubber sheet 14 overlies the upper surface of printed circuit board 13, and is provided with an arch portion 141 which projects in an arcuate form over fixed contacts 131. Arch portion 141 is in press-contact with a bottom portion of key 11 and urges key 11 upwardly. Arch portion 141 is provided with a movable contact 15 on the inner surface thereof. Accordingly, when key 11 is pushed down against the elastic support by arch portion 141, movable contact 15 comes into contact with fixed contacts 131 and connect them with one another.

Key 11 has a face plate portion 111 and a plurality of elastically flexible leg portions 112 extending downwardly from face plate portion 111 through the opening 121 of hiousing plate 12. Each of leg portions 112 has a foot 113 at the extended end thereof. Foot 113 extends outwardly for engaging with the edge of the opening 121 of housing plate 12 to prevent key 11 from slipping out of opening 121.

In the known key switch device, if a force $F_1$ or $F_2$ is applied to a point adjacent to the peripheral edge of the upper surface of face plate portion 111, key 11 is inclined from the center axis of opening 121 with leg portions 112 bending inwardly. Therefore, key 11 is not pushed straight down by the force $F_1$ or $F_2$ and movable contact 15 does not reliably come into contact with fixed contacts 131.

According to the present invention, the key switch device is provided with key guide means for reliably guiding the key to move along the center axis of the opening of the housing plate in addition to engaging means for preventing the key from slipping out of the housing plate.

Figure 3:
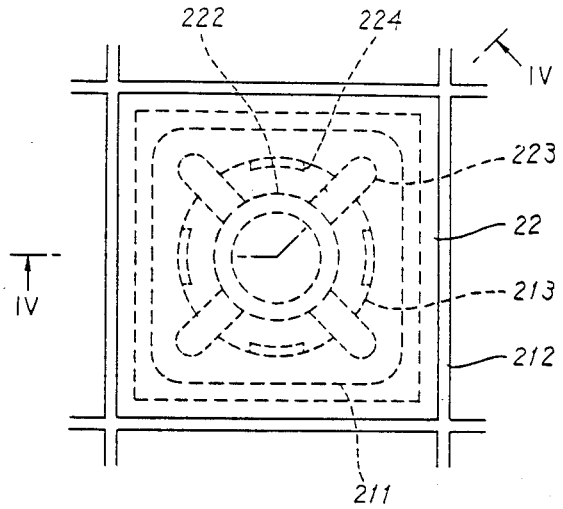
FIG. 3 is a plan view of an embodiment of key switch device according to the present invention.
Figure 4:
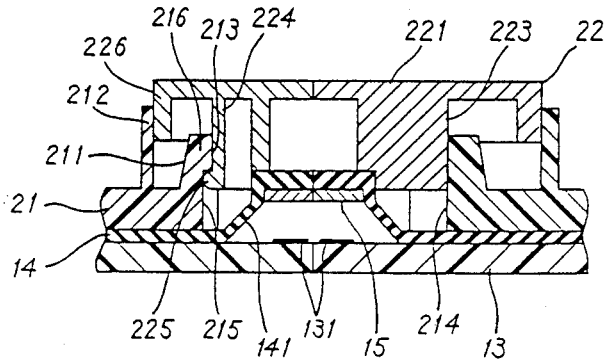
FIG. 4 is a sectional view along a line IV—IV in FIG. 3.

Referring to FIGS. 3 and 4, an embodiment of a key switch device shown therein includes a printed electric circuit board 13 having a pair of fixed contact 131 on an upper surface thereof, a rubber sheet 14 overlying an upper surface of printed circuit board 13 and being provided with an arch portion 141 which projects in an arcuate form over fixed contacts 131, and a movable contact 15 being fixedly secured on an inner surface of arch portion 141, similar to the device in FIG. 2.

Figure 5:
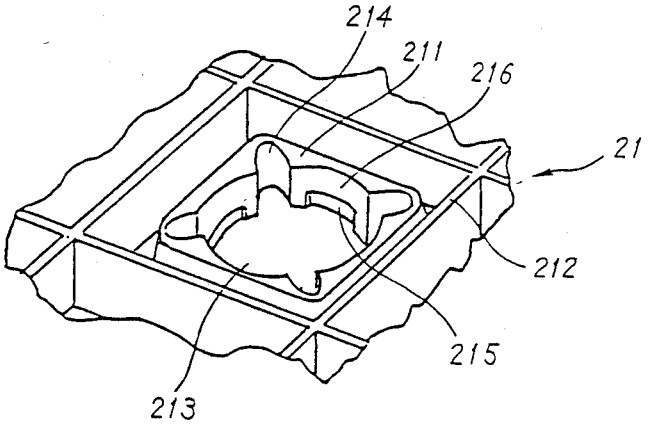
FIG. 5 is a perspective view of a housing plate used in the key switch device illustrated in FIGS. 3 and 4.

A housing plate 21 is disposed on, and in close contact with, an upper surface of rubber sheet 14 and fixedly secured to printed circuit board 13 by suitable means (not shown). Referring to FIG. 5 in addition to FIGS. 3 and 4, housing plate 21 includes a square hill portion 211 on an upper surface thereof and a surrounding wall 212 around hill portion 211. As illustrated in FIG. 4, surrounding wall 212 is higher than hill portion 211. A circular opening 213 is formed in hill portion 211 and extends through its entire thickness. As a result, opening 213 has a center axis perpendicular to the upper surface of printed circuit board 13. Arch portion 141 of rubber sheet 14 is located in opening 213 of housing plate 21.

Four guide grooves 214 are formed in an inner peripheral surface of opening 213 and on two diagonals of the square hill portion 211. Each of guide grooves 214 is extended in parallel with the center axis of opening 213. Four shallow grooves 215 are also formed in the inner peripheral surface of opening 213 but at locations between adjacent ones of the four guide grooves 214. Each of the shallow grooves 215 extends from a bottom surface of housing plate 21 to a location in the vicinity of an upper surface of hill portion 211 in parallel with the center axis of opening 213 of housing plate 21. Thus, an engaging shoulder portion 216 is left in the form of an upper dam for terminating each shallow groove 215.

Figure 6:
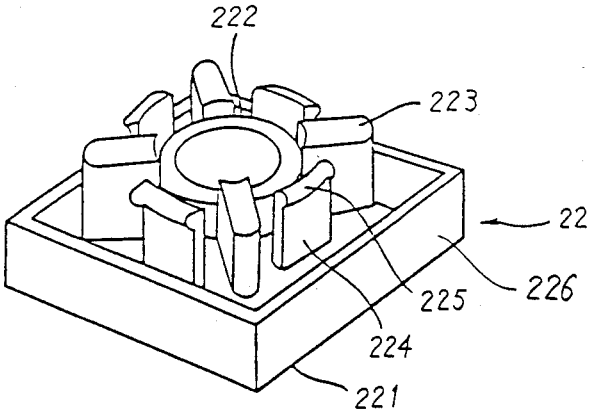
FIG. 6 is a perspective view of a key used in the key switch device illustrated in FIGS. 3 and 4.

This embodiment further includes a key 22 which is shown in detail in FIG. 6. Referring to FIG. 6, key 22 has a square face plate portion 221, as shown in FIG. 3, a central protrusion 222 protruding perpendicularly from a center portion on a bottom surface of face plate portion 221, four guide projections 223 projecting perpendicularly from the bottom surface of face plate portion 221, and four leg portions 224 projecting from the bottom surface of face plate portion 221 and extending parallel with central protrusion 222. Guide projections 223 radially outwardly extend from an outer peripheral surface of central protrusion 222 along two diagonals of the square shape of face plate portion 221. Leg portions 224 are located in angular spaces between guide projections 223, respectively. Each of leg portions 224 is long and narrow to be elastically flexible in a radial direction and provided with a foot portion 225 which extends outwardly from a projected end of the leg portion. Since guide projections 223 and leg portions 224 are formed at positions angularly spaced from one another, each of them can be formed sufficiently long.

In mounting key 22 onto housing plate 21, leg portions 224 are pressedly inserted into opening 213 with radial deformation of leg portions 224, and guide projections 223 are slidably fitted into guide grooves 214, respectively. Thereafter, when key 22 is further pushed down, central protrusion 222 is pressed onto arch portion 141 of rubber sheet 14 and foot portions 225 are fitted into shallow grooves 215 by the restoring force of leg portions 224, respectively. As a result, key 22 is elastically supported on top surface of arch portion 141 and prevented from slipping out thereof from opening 213 by respective engagement of foot portions 225 with engaging shoulder portions 216.

In the shown embodiment, guide projections 223 and leg portions are formed inside the outer peripheral edge of face plate portion 221 of key 22. That is, face plate portion 221 has a top surface having an area larger than that of the opening 213 of the housing plate.

The face plate portion 221 is also provided with a skirt portion 226 extending downwardly from the outer peripheral edge. The skirt portion is fitted into surrounding wall 212 of housing plate 21 with a small gap therebetween.

In use of the key switch device, when key 22 is pushed down by an operating force which applied at any point on the upper surface of face plate portion 221, movable contact 15 reliably comes into contact with fixed contacts 131. Since the embodiment is provided with key guide means comprising guide grooves 214 and guide projections 223, key 22 is smoothly and straight downwardly along the center axis of opening 213 without being inclined from the center axis. Therefore, electrical connection between movable contact 15 and fixed contacts 131 is reliably achieved. If the operating force is released, key 22 is moved upwardly by the restoring force of arch portion 141 of rubber sheet 14 until foot portions 225 engage with engaging shoulder portions 216.

Although four guide grooves 214 and four guide projections 223 are shown in FIGS. 3 to 6, it will be readily understood that a number of pairs of guide groove and guide projection may be more or less than four.

What is claimed is:

1. In a key switch device which comprises an electric circuit board having a pair of fixed contacts on an upper surface thereof, a housing plate fixedly disposed on the upper surface of said circuit board and having an opening with a center axis intersecting the upper surface of said circuit board, a key mounted on said housing plate to be movable along the center axis of said opening, supporting means for elastically supporting and urging said key upwardly, and a movable contact accompanied with said key to come into contact with said pair of fixed contacts each time that said key is pushed downwardly, the improvement wherein said housing plate has a plurality of guide grooves formed at angularly spaced locations in an inner peripheral surface of said opening to extend parallel to the center axis of said opening, said key including a face plate portion having a bottom surface, a plurality of guide projections projecting from said bottom surface of said face plate portion and slidably fitted in said guide grooves, respectively, and a plurality of leg portions projecting from the bottom surface of said face plate portion and angularly spaced from said guide projections, said leg portions being fitted into said opening and arranged around the center axis of said opening, each of said leg portions being elastically flexible in a radial direction of said opening and having engaging means for engaging with said housing plate to prevent said key from slipping out of said opening upwardly.

2. The key switch device as claimed in claim 1, wherein said key includes a central protrusion protruding from the bottom surface of said face plate portion along the center axis of said opening, said guide projections being integral with said central protrusion and extending radially outwardly from said central protrusion through respective angular spaces between adjacent ones of said leg portions.

3. The key switch device as claimed in claim 1, wherein said engaging means of each of said leg portions comprises a foot portion extending radially outwardly from the projecting end of each of said leg portions, the peripheral surface of said opening having a plurality of shallow grooves for receiving therein said foot portions, respectively, each of said shallow grooves extending from a bottom surface of said housing plate to a location in the vicinity of an upper surface of said housing plate parallel with the axis of said opening to leave an upper dam portion terminating each shallow groove, said foot portions being received in said shallow grooves and engaging with said dam portions, respectively, to prevent said key from slipping out of said opening.

4. The key switch device as claimed in claim 1, wherein said guide projections and said leg portions are formed at positions inwardly of the outer peripheral edge of said face plate portion of said key.

5. The key switch device as claimed in claim 4, wherein said housing plate further comprises a wall portion surrounding said key with a small gap between the outer peripheral edge of said face plate portion and the inner surface of said wall portion.

6. The key switch device as claimed in claim 3, wherein said key is provided with four guide projections and four leg portions, said four guide projections being arranged at angularly spaced positions from one another around the center axis of said opening, each of said four leg portions being positioned in respective angular spaces between adjacent ones of said guide projections.

7. The key switch device as claimed in claim 6, wherein said face plate portion of said key is square, said guide projections radially outwardly extending along two diagonals of said square face plate portion.

8. The key switch device as claimed in claim 1 wherein said guide projections extend radially of said opening and said leg portions extend arcuately of said opening between adjacent guide projections.

9. The key switch device as claimed in claim 8 wherein said housing plate includes a hill portion and a wall surrounding said hill portion with a gap therebetween, said hill portion being provided with said opening centrally thereof, said guide grooves extending radially from said opening, said leg portions engaging the portion of said opening in said hill portion between said guide grooves.

10. The key switch device as claimed in claim 9 wherein said key includes a skirt which is received within said wall.

11. The key switch device as claimed in claim 10 wherein said wall has a height from said bottom surface of said face plate portion which is greater than the height of said hill portion.

* * * * *